United States Patent [19]

Jones et al.

[11] 3,949,214

[45] Apr. 6, 1976

[54] VEHICLE LAMP ASSEMBLY

[75] Inventors: Kenneth James Jones; Robert Arthur Hargroves, West Midlands, both of England

[73] Assignee: The Lucas Electrical Company Limited, Birmingham, England

[22] Filed: Feb. 27, 1975

[21] Appl. No.: 553,824

[30] Foreign Application Priority Data

Mar. 5, 1974 United Kingdom..... 9752/74

[52] U.S. Cl... 240/41.35 C; 240/41.1; 240/41.35 A; 240/46.01

[51] Int. Cl.² ..... F21V 7/00

[58] Field of Search 240/41.35 C, 41.35 A, 41.35 D, 240/41.1, 41.4, 46.01, 46.47, 41 R

[56] References Cited

UNITED STATES PATENTS

| | | | |
|---|---|---|---|
| 1,589,624 | 6/1926 | Bronson | 240/41.1 |
| 2,185,438 | 1/1940 | Herman | 240/41.1 |
| 3,142,444 | 7/1964 | Nascimbene | 240/41.35 C |
| 3,752,408 | 8/1973 | Tixier | 240/41.1 X |

*Primary Examiner*—R. L. Moses
*Attorney, Agent, or Firm*—Holman & Stern

[57] ABSTRACT

The vehicle lamp assembly comprises a housing having a window therein. Disposed within the housing is a first ellipsoidal reflector, a mask, a second ellipsoidal reflector, and a concave mirror. The mask is disposed in the inner focal planes of the respective reflectors and is also disposed at the focal plane of the concave mirror. The second reflector is disposed on the opposite side of the mask to the first reflector and the mask on the side thereof facing the second reflector is silvered. When a filament in the first reflector only is illuminated, a dipped beam pattern is provided. When both of the filaments are illuminated, a full beam pattern is provided because the dipped beam pattern is modified by light from the second reflector being reflected off the mask towards the concave mirror.

4 Claims, 2 Drawing Figures

VEHICLE LAMP ASSEMBLY

This invention relates to a vehicle lamp assembly and has for its object to provide a vehicle lamp assembly which can readily and selectively produce a so-called "dipped" beam pattern or a so-called "full" or "main" beam pattern.

According to the present invention, there is provided a vehicle lamp assembly comprising a housing having a window therein, a first curved reflector and a first bulbholder mounted in the housing, a second curved reflector and second bulbholder also mounted in the housing, a curved mirror mounted in the housing, and a mask disposed between the first curved reflector and the curved mirror, the arrangement of first curved reflector, first bulbholder, mask and curved mirror being such that, in use, when a bulb is mounted in the bulbholder, a part of the light beam from the bulb is directed by the first reflector towards the curved mirror and is masked by the mask, the masked beam being reflected by the curved mirror to leave the housing through the window, said mask having a reflective layer on a surface thereof which faces away from the first reflector, and said second reflector and second bulbholder being mounted on the opposite side of the mask to the first reflector and being arranged so that, in use, a light beam emanating from a bulb carried by the second bulbholder is directed by the second reflector towards the reflective layer on the mask to be reflected thereby towards the mirror which reflects the beam through the window.

Thus, when only the bulb associated with the first reflector and the first bulbholder is illuminated, a masked beam pattern is produced which is used as a "dipped" beam. When both of the bulbs are illuminated, the portion of the beam which has been removed by the mask is filled in by the beam reflected off the reflective layer on the mask. In this manner, a "full" or "main" beam pattern is projected by the lamp assembly without the need to move the mask.

Conveniently, the second reflector is at least partially ellipsoidal.

The first reflector may also be at least partially ellipsoidal and the arrangement may be such that the mask lies at the outer focal plane of both of the reflectors.

An embodiment of the present invention will now be described, by way of example, with reference to the accompanying drawing, in which:-

Figure 1:
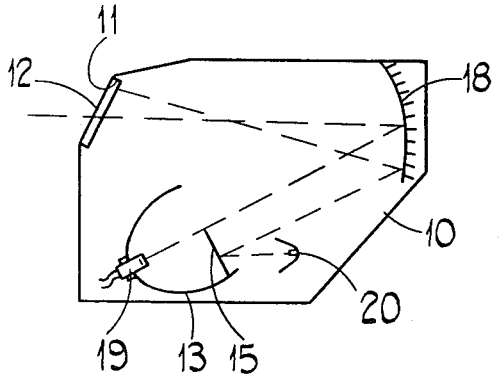
Figure 2:
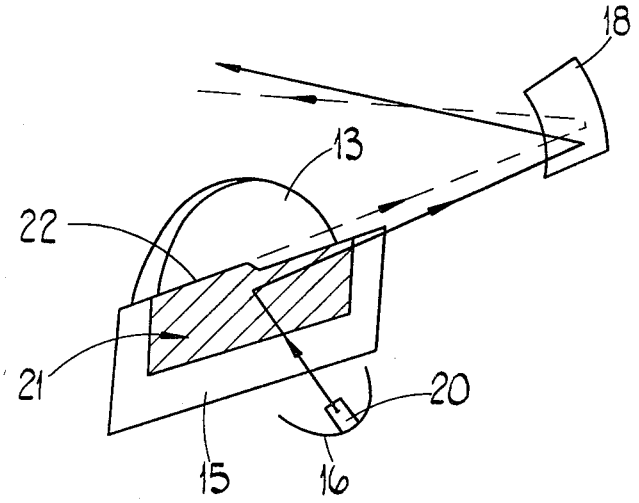

FIG. 1 is a schematic elevation of a vehicle lamp assembly according to the present invention, and FIG. 2 is a schematic perspective view, on a larger scale, of part of the vehicle lamp assembly of FIG. 1.

Referring to the drawing, the vehicle lamp assembly comprises a housing 10 having a window 11 therein, a transparent lens 12 disposed in the window 11, a first reflector 13, a first bulbholder 14, a mask 15, a second reflector 16, second bulbholder 17, and a concave mirror 18. The first reflector 13 is of ellipsoidal shape and the first bulbholder 14 mounts a first bulb 19 with its filament lying in the inner focal plane of the reflector 13. The mask 15 lies in the outer focal plane of the reflector 13. The second reflector 16 is also of ellipsoidal shape and the second bulbholder 17 carries a second bulb 20 whose filament lies in the inner focal plane of the second reflector 16. The second reflector 16 is arranged relative to the first reflector 13 in such a manner that the mask 15 also lies on the outer focal plane of the second reflector 16. A reflective layer 21 is provided on a surface of the mask 15 which faces away from the first reflector 13. The mask 15 also lies in the focal plane of the concave mirror 18.

The arrangement is such that, in use, when the first bulb 19 is illuminated, the light beam is directed by the first reflector 13 towards the concave mirror 18. Due to the presence of the mask 15, the light beam reaching mirror 18 is masked and the positioning of the mask is such that a light beam is reflected from the mirror 18 through the lens 12 with an upper portion thereof cut-off to a pattern defined by an upper edge 22 of the mask 15. This cut-off beam pattern is a so-called "dipped" beam pattern and is intended to be used by a driver of a road vehicle fitted with the lamp assembly in conditions where dazzling of other road users is to be avoided.

When a driver of the road vehicle wishes to increase the illumination provided by the lamp assembly, he operates a switch (not shown) which causes the second bulb 20 to be illuminated. The beam emanating from the second bulb 20 is directed by the second reflector 16 towards the reflective layer 21 on the mask 15. This light beam is reflected by the reflective layer 21 towards the mirror 18 where it is again reflected and passes out of the housing 10 through the lens 12. Due to the relative positioning of the components 13, 15, 16 and 18, the beam pattern derived from the second reflector 16 serves to fill in that portion of the first mentioned light beam which has been removed by mask 15.

In this manner, the above-described vehicle lamp assembly can provide both dipped and full or main beams without the need to move the mask 15.

We claim:

1. A vehicle lamp assembly comprising a housing having a window therein, a first curved reflector and a first bulbholder mounted in the housing, a second curved reflector and second bulbholder also mounted in the housing, a curved mirror mounted in the housing, and a mask disposed between the first curved reflector and the curved mirror, the arrangement of first curved reflector, first bulbholder, mask and curved mirror being such that, in use, when a bulb is mounted in the bulbholder, part of the light beam from the bulb is directed by the first reflector towards the curved mirror and is masked by the mask, the masked beam being reflected by the curved mirror to leave the housing through the window, said mask hving a reflective layer on a surface thereof which faces away from the first reflector, and said second reflector and second bulbholder being mounted on the opposite side of the mask to the first reflector and being arranged so that, in use, a light beam emanating from a bulb carried by the second bulbholder is directed by the second reflector towards the reflective layer on the mask to be reflected thereby towards the mirror which reflects the beam through the window.

2. A vehicle lamp assembly as claimed in claim 1, wherein the second reflector is at least partially ellipsoidal.

3. A vehicle lamp assembly as claimed in claim 1, wherein the first reflector is at least partially ellipsoidal.

4. A vehicle lamp assembly as claimed in claim 3, wherein the mask lies at an outer focal plane of each of the reflectors.

* * * * *